US009055775B2

(12) United States Patent
Taul

(10) Patent No.: US 9,055,775 B2
(45) Date of Patent: Jun. 16, 2015

(54) DUAL PURPOSE SCARF ACCESSORY AND OUTER PROTECTIVE GARMENT

(76) Inventor: Marilyn Taul, Overland Park, KS (US)

( * ) Notice: Subject to any disclaimer, the term of this patent is extended or adjusted under 35 U.S.C. 154(b) by 724 days.

(21) Appl. No.: 13/311,672

(22) Filed: Dec. 6, 2011

(65) Prior Publication Data

US 2012/0137416 A1 Jun. 7, 2012

Related U.S. Application Data

(60) Provisional application No. 61/420,086, filed on Dec. 6, 2010.

(51) Int. Cl.

| | |
|---|---|
| ***A41D 1/04*** | (2006.01) |
| ***A41D 23/00*** | (2006.01) |
| ***A41D 27/10*** | (2006.01) |
| *A41D 13/05* | (2006.01) |
| *A41D 1/00* | (2006.01) |

(52) U.S. Cl.

CPC ..... *A41D 23/00* (2013.01); *A41D 13/0512* (2013.01); *A41D 1/00* (2013.01); *A41D 1/04* (2013.01); *A41D 27/10* (2013.01)

(58) Field of Classification Search

CPC ..... A41D 1/00; A41D 1/04; A41D 13/0512; A41D 27/10

USPC ..... 2/461, 69, 91, 16, 463, 44, 50, 51, 174, 2/203, 204, 207, 244

See application file for complete search history.

(56) References Cited

U.S. PATENT DOCUMENTS

| | | | | | |
|---|---|---|---|---|---|
| 1,235,917 | A | * | 8/1917 | Bradley | 101/133 |
| 2,237,368 | A | * | 4/1941 | Seitzman et al. | 2/91 |
| 4,404,688 | A | | 9/1983 | Knight | |
| 4,559,647 | A | * | 12/1985 | Smith et al. | 2/158 |
| 4,570,267 | A | * | 2/1986 | Appel | 2/91 |
| 4,677,622 | A | * | 6/1987 | Okamoto et al. | 714/756 |
| 4,706,304 | A | | 11/1987 | Jones | |
| D364,722 | S | | 12/1995 | Kallonakis | |
| 5,867,835 | A | | 2/1999 | Dabbieri | |
| 6,226,799 | B1 | | 5/2001 | Lane | |
| 6,665,876 | B1 | | 12/2003 | Newman | |
| D639,024 | S | * | 6/2011 | Benderradji | D2/830 |
| 2009/0000005 | A1 | | 1/2009 | Amson | |
| 2012/0079644 | A1 | * | 4/2012 | Benderradji | 2/207 |

* cited by examiner

*Primary Examiner* — Danny Worrell
*Assistant Examiner* — Khaled Annis
(74) *Attorney, Agent, or Firm* — Dunlap Codding, P.C.

(57) ABSTRACT

A dual purpose garment is wearable as a neck scarf accessory or as an outer protective garment covering at least a portion of the shoulders and arms. First and second arm-covering sections extend equally from a centrally located section of the garment, wherein the centrally located section and arm-covering sections can protect the shoulders and arms when worn in an outer protective garment configuration. However, the arm-covering sections extend only to end sections which remain open in a neck scarf accessory configuration to allow the garment to resemble an ordinary neck scarf.

13 Claims, 5 Drawing Sheets

DUAL PURPOSE SCARF ACCESSORY AND OUTER PROTECTIVE GARMENT

CROSS-REFERENCE TO RELATED APPLICATIONS

The present application claims priority to the provisional patent application identified by U.S. Ser. No. 61/420,086, filed on Dec. 6, 2010. The entire content of the provisional patent application identified by U.S. Ser. No. 61/420,086 is hereby expressly incorporated herein by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

BACKGROUND

1. Field of the Presently Disclosed and Claimed Inventive Concept(s)

The inventive concepts disclosed and claimed herein relate generally to wearing apparel and, more particularly, but not by way of limitation, to a combination neck scarf accessory and protective garment for the back and arms.

2. Background of the Presently Disclosed and Claimed Inventive Concept(s)

It is often desirable to wear a scarf tied about the neck for decorative purposes. Such scarves provide very little warmth, however, especially when worn with, for example, a sleeveless dress. Restaurants and other establishments can often seem cold to a woman in sleeveless apparel and yet warm to another in a sports coat or jacket. It would be useful to have wearing apparel that could function as both a decorative accessory and as an outer protective garment covering at least a portion of the shoulder and arms, thereby offering warmth.

A protective sleeve that can also be worn as headwear or around an athlete's neck for protection was disclosed in U.S. Pat. No. 6,665,876. While such a protective sleeve can potentially be worn around the neck for warmth, it does not resemble a standard rectangular elongated neck scarf, and would not function as such a decorative accessory. Similarly, an elongated, tubular garment is disclosed in U.S. Pat. No. 4,706,304 which provides protection for a person's arms and can even include a hood. However, the tubular garment cannot be opened to resemble a decorative neck scarf in shape and therefore would not function as such a decorative accessory. Finally, U.S. Pat. No. 6,226,799 provides a scarf having an additional back portion and neck portion designed to provide additional warmth. However, such a scarf neither provides covering for the arms, nor resembles a decorative neck scarf in shape.

In light of the foregoing, there is a need for a dual purpose accessory that can be positioned as a decorative neck scarf or as a decorative protective garment covering at least a portion of the shoulders and arms. It is to such a dual purpose accessory and method that the presently disclosed and claimed inventive concept(s) is directed.

SUMMARY OF THE INVENTION

A dual purpose garment is adapted to be worn about the neck of a person as a neck scarf accessory, and alternatively to fit over the arms and across the shoulders of a person when worn as an outer protective garment. The dual purpose garment comprises an elongated, fabric member with a width of about 6 to 36 inches and a length greater than the width, and having a centrally-located section midway along its length. First and second arm-covering sections extend equally from the centrally-located section and longitudinally along the length of the elongated fabric member. The first arm-covering section has longitudinal edges connected at a first longitudinal connection to form a first tubular sleeve. Similarly, the second arm-covering section has longitudinal edges connected at a second longitudinal connection to form a second tubular sleeve. First and second end sections extend equally from the first and second arm-covering sections, respectively, and include end edges defined by the end edges of the elongated fabric member. Unlike the arm-covering sections, the first and second end sections are without connected longitudinal edges and thus give the appearance of a standard rectangular neck scarf when the dual purpose accessory is worn about the neck leaving the first and second end sections to drape down from the neck of the individual wearing the accessory. First fasteners are positioned adjacent an end edge of the first end section such that when fastened, and the dual purpose garment worn as an outer protective garment, the first end section is releasably secured about a first wrist of the wearer. Similarly, second fasteners are positioned adjacent an end edge of the second end section such that when fastened, and the dual purpose garment worn as an outer protective garment, the second end section is releasably secured about a second wrist of a wearer.

In another embodiment, the dual purpose garment comprises an elongated fabric member having first and second end edges and first and second longitudinal edges. At least portions of the first and second longitudinal edges are connectable to one another via releasably closeable perimeter fasteners, such that fastening can provide first and second tubular arm covering sections when worn as a protective garment. First and second fasteners, positioned adjacent the end edges of the first and second end sections, respectively, releasably secure the end edges of the first and second end sections about the wrists of the person when wearing the garment as an outer protective garment.

A method of making the dual purpose garment positionable as a neck scarf accessory or as a protective garment covering at least a portion of the shoulders and arms of a person wearing the garment, includes the following steps. An elongated fabric member is provided having first and second longitudinal edges with a length in a range of from about 30 to 90 inches and having first and second end edges with an end width in a range of from about 6 to 24 inches. Releasably closeable perimeter fasteners are attached to the first and second longitudinal edges such that at least portions of the first longitudinal edge can be releasably connected to opposing portions of the second longitudinal edge to form two tubular sections suitable for positioning about the arms of a wearer. First fasteners are attached adjacent the first end edge such that when fastened, the first end edge is releasably secured about a first wrist of a wearer. Similarly, second fasteners are attached adjacent the second end edge such that when fastened, the second end section is releasably secured about a second wrist of a wearer.

In another embodiment, a method of making the dual purpose garment positionable as a neck scarf accessory or as a protective garment covering at least a portion of the shoulders and arms of a person wearing the garment, includes the following steps. An elongated fabric member is provided having first and second longitudinal edges with a length in a range of from about 30 to 90 inches and having first and second end edges with an end width in a range of from about 6 to 24 inches. Portions of the first longitudinal edge are sewn or glued to opposing portions of the second longitudinal edge to provide first and second longitudinal connections, thereby forming first and second tubular arm-covering sections. The first and second longitudinal connections extend equally from a point about 6 to 15 inches from the center of the elongated fabric member toward a nearest end edge, stopping short of the nearest end edge to leave first and second end sections extending equally from the first and second longitudinal connection respectively. The first and second end sections have unconnected longitudinal edges and a length of at least about 3 inches. First fasteners are attached adjacent the first end edge such that when fastened, the first end edge is releasably secured about a first wrist of a wearer. Similarly, second fasteners are attached adjacent the second end edge such that when fastened, the second end section is releasably secured about a second wrist of a wearer Thus, utilizing (1) the technology known in the art; (2) the above-referenced general description of the presently claimed and disclosed inventive concept(s); and (3) the drawings and detailed description of the inventive concepts that follows, the advantages and novelties of the presently claimed and disclosed inventive concept(s) are readily apparent to one of ordinary skill in the art.

BRIEF DESCRIPTION OF THE DRAWINGS

Like reference numerals in the figures represent and refer to the same element or function. Implementations of the disclosure may be better understood when consideration is given to the following detailed description thereof. Such description makes reference to the annexed pictorial illustrations, schematics and drawings. The figures are not necessarily to scale and certain features and certain views of the figures may be shown exaggerated in the interest of clarity and conciseness. In the drawings.

DETAILED DESCRIPTION OF EXEMPLARY EMBODIMENTS

Figure 1:
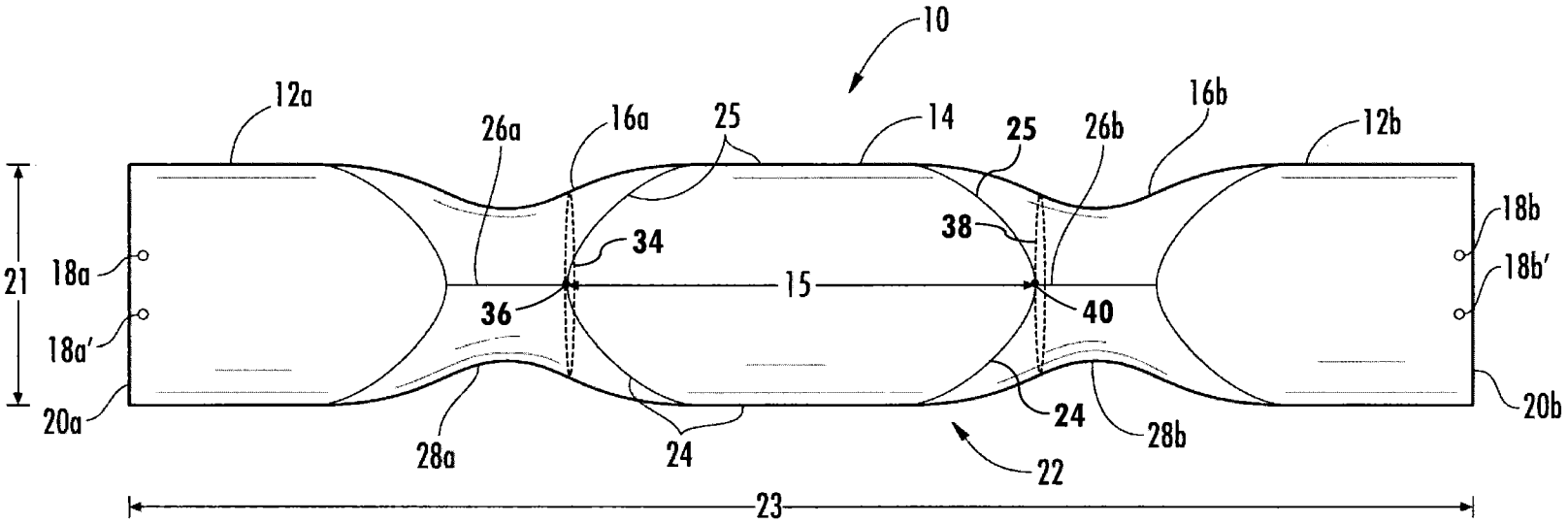
FIG. 1 is a pictorial representation of an embodiment of a dual purpose garment of the present invention.

Before explaining at least one embodiment of the inventive concepts(s) disclosed herein in detail, it is to be understood that the inventive concept(s) is not limited in its application to the details of construction and the arrangement of the components or steps or methodologies set forth in the following description or illustrated in the drawings. The inventive concept(s) disclosed herein is capable of other embodiments or of being used or manufactured in various ways. Also, it is to be understood that the phraseology and terminology employed herein is for the purpose of description and should not be regarded as limiting.

In the following detailed description of embodiments of the disclosure, numerous specific details are set forth in order to provide a more thorough understanding of the disclosure. However, it will be apparent to one of ordinary skill in the art that the concepts within the disclosure can be practiced without these specific details. In other instances, well-known features have not been described in detail to avoid unnecessarily complicating the description.

Figure 2:
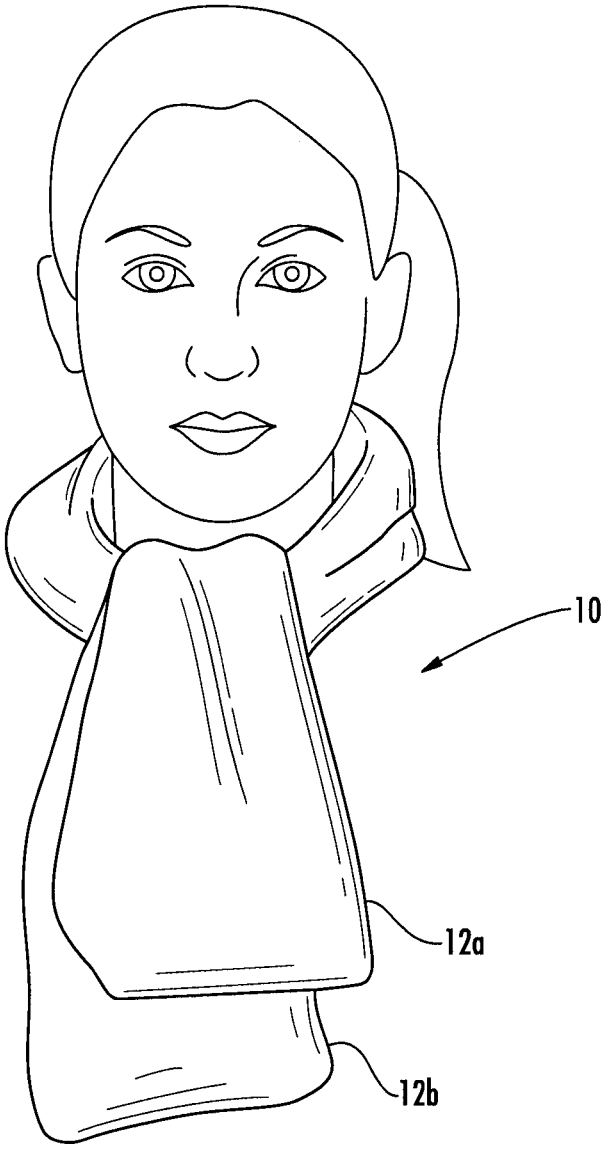
FIG. 2 is a pictorial representation of a person wearing an embodiment of the dual purpose garment positioned as a neck scarf.
Figure 3:
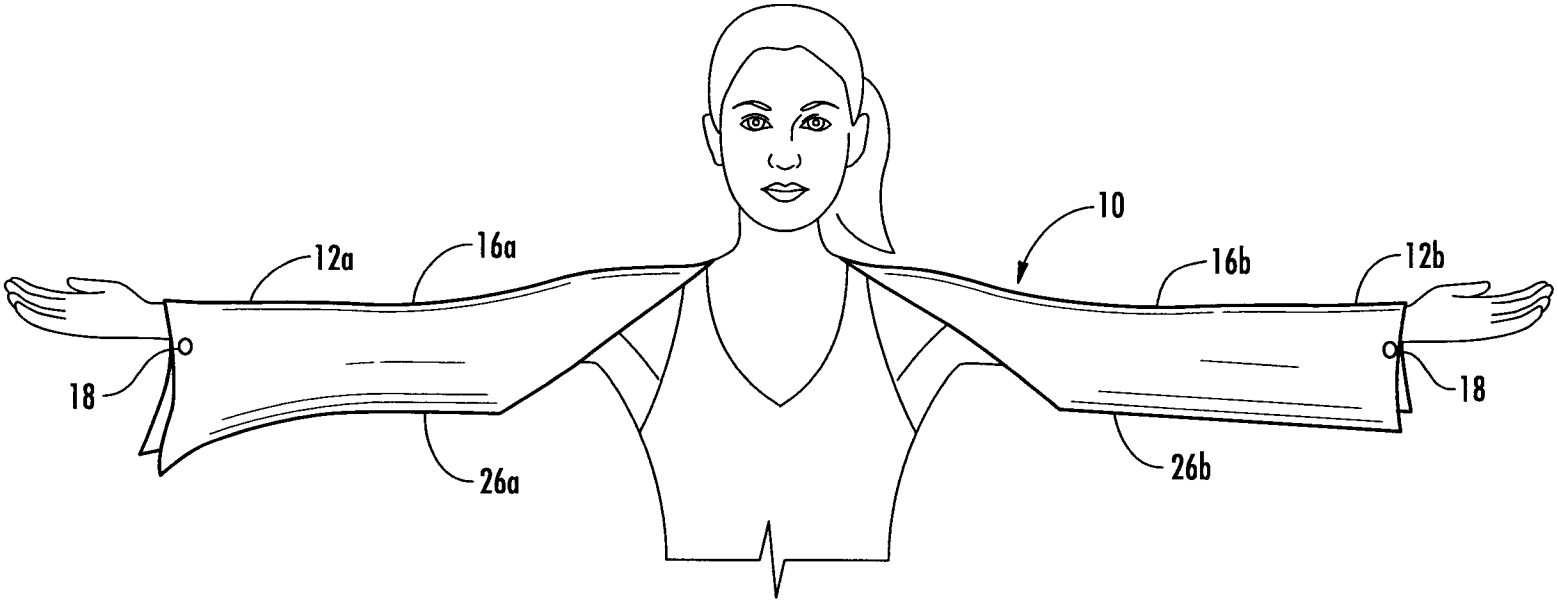
FIG. 3 is a pictorial representation of a front view of a person wearing an embodiment of the dual purpose garment positioned as an outer protective garment covering at least a portion of the shoulders and arms.
Figure 4:
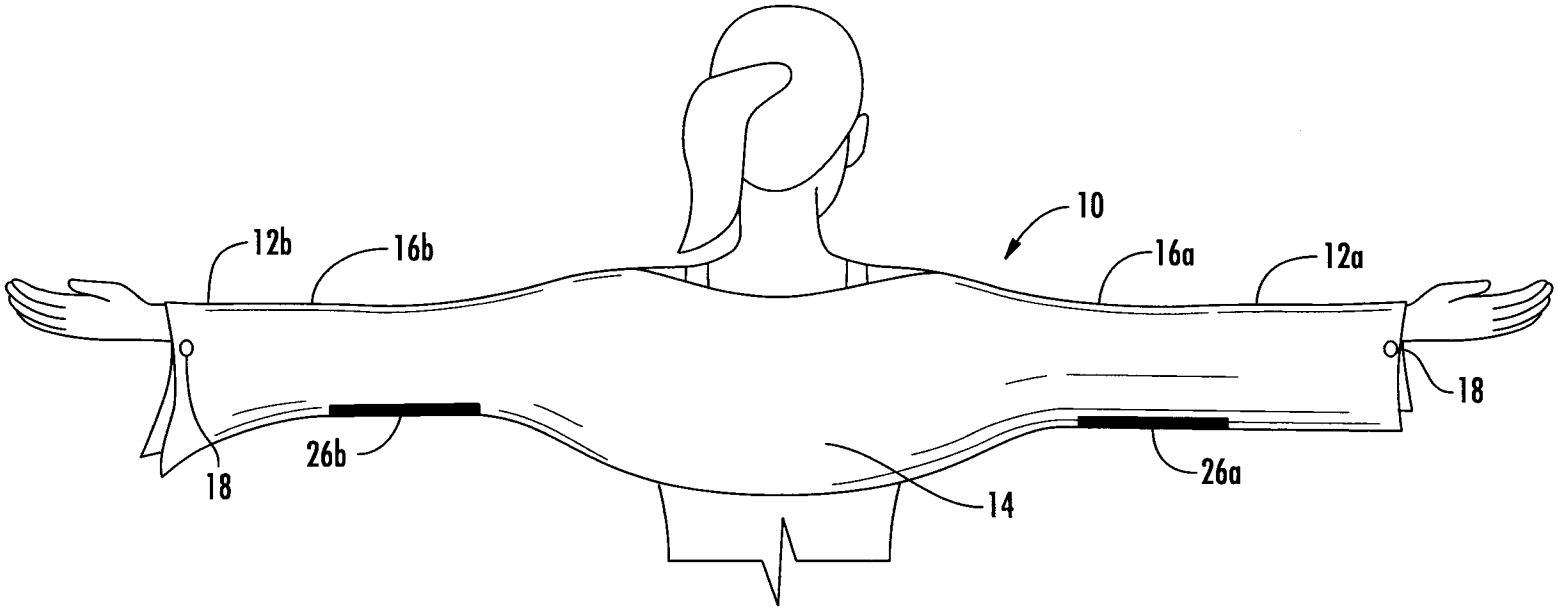
FIG. 4 is a pictorial representation of a back view of a person wearing an embodiment of the dual purpose garment positioned as an outer protective garment covering at least a portion of the shoulders and arms.

The inventive concept(s) disclosed herein is directed to a dual purpose garment positionable as a neck scarf accessory or as an outer protective garment. Referring now to FIG. 1 and FIG. 2, the dual purpose garment 10, when worn and positioned as a neck scarf accessory, appears as a standard neck scarf having first and second end sections 12*a* and 12*b* that are indistinguishable from a similarly worn accessory scarf. Because a neck scarf accessory provides little or no warmth to the shoulders and arms, the dual purpose garment 10 is designed to be repositionable for wearing draped about a wearer's shoulders as shown in FIG. 3 and FIG. 4, with a centrally located section 14 open to protect at least a portion of the wearer's back and shoulders, and with arm covering sections 16*a* and 16*b* for inserting the wearer's arms. The dual purpose garment 10 will provide warmth when worn and positioned over bare arms and will provide additional warmth when worn and positioned over the shoulders and arms of an individual wearing short or long sleeves underneath the dual purpose garment 10. When worn and positioned as an outer protective garment, fasteners 18 can be used to secure the garment 10 about a wrist of the wearer. For example, fasteners 18*a* and 18*a*', positioned and affixed on the dual purpose garment 10 adjacent a first end edge 20*a*, can be fastened together; and fasteners 18*b* and 18*b*' positioned and affixed adjacent a second end edge 20*b* can be fastened together, to thusly secure the end sections 12*a* and 12*b* about each wrist of the wearer. This helps to free the hands and allows the wearer to, for example, eat dinner while wearing the dual purpose garment 10 in an outer protective garment configuration, without otherwise necessary concern for reaching over a plate of food.

The dual purpose garment 10 is formed from an elongated, often generally rectangular, fabric member 22. The fabric member can be a single section of fabric or several sections joined together. Typically the elongated fabric member 22 has a width of about 6 to 36 inches and a length greater than the width. While it is anticipated that the fabric member will be generally rectangular in shape, the actual shape can be modified without losing the inventive aspects of the presently disclosed and claimed inventive concept(s). For example, the elongated fabric member 22 can be broader at the centrally located section 14 and tapered toward the first and second end sections 12*a* and 12*b*, or vice versa. Further, the edges can be straight or non-linear, for example, curved, scalloped or tasseled. The length 23 of the elongated fabric member 22, as well as the length of dual purpose garment 10, can vary widely, but is often in a range of from about 30 to 90 inches. For an average size woman, the length 23 of elongated fabric member 22 is typically in a range of from about 50 to 65 inches. For a young girl the length of elongated fabric member 22 can be in a range of from about 30 to about 50 inches.

Elongated fabric member 22 can be made of any material suitable for a neck scarf and can be light weight or heavy weight, woven, non-woven, knit, crochet, and the like. The weave, knit, etc. can be either loose or tight. Non limiting examples of suitable fabrics include silk, polyester, rayon, nylon, spandex, cotton, wool, polypropylene, polyamide, and polyacrylic, cotton, fur, leather, suede, chiffon, cashmere, and any mixture of the above. The elongated fabric member 22 may also be made from a combination of materials woven together or sewn together in sections. Optionally, elongated fabric member 22 can have fringe at one or both end edges 20*a* and 20*b* and at one or both longitudinal edges 24 and 25. Ribbon, lace, sequins, glitter, buttons, and other decorative items may also be attached to the elongated fabric member 22.

First and second arm-covering sections 16*a* and 16*b*, respectively, extend equally from the centrally-located section 14 and longitudinally along the length of the elongated fabric member 22. Longitudinal edges 24 and 25 along the first arm-covering section 16*a* are connectable at a first longitudinal connection 26*a* to form a first sleeve 28*a*. Similarly, longitudinal edges 24 and 25 along the second arm-covering section 16*b* are connectable at a second longitudinal connection 26*b* to form second sleeve 28*b*. In FIG. 4, first and second longitudinal connections 26*a* and 26*b*, respectively, are emphasized and designated with bold lines. First and second longitudinal connections 26*a* and 26*b*, respectively, can be permanent such as a sewn, glued, or otherwise fixed seam. Alternatively, first and second longitudinal connections 26*a* and 26*b*, respectively, can be releasably closable utilizing Velcro®, zippers or the like, or by utilizing other releasably closable perimeter fasteners 30. For example, a series of pairing connectors such as snaps, button and hole pairs, hook and eye pairs, and the like can be utilized. In one embodiment, first and second longitudinal connections 26*a* and 26*b*, respectively, are configured such that dual purpose garment 10 is reversible. Such methods and components are well known to those skilled in the art.

The centrally located section 14 is that portion of the elongated fabric member 22 within a perimeter defined by the longitudinal edge 24, the longitudinal edge 25, a first perpendicular edge 34, and a second perpendicular edge 38. The first perpendicular edge 34 is formed by the intersection of the elongated fabric member 22 with a plane perpendicular to the first longitudinal connection 26*a* and passing through a first innermost point 36 of the first longitudinal connection 26*a*. Similarly, the second perpendicular edge 38 is formed by the intersection of the elongated fabric member 22 with a plane perpendicular to the second longitudinal connection 26*b* and passing through a second innermost point 40 of the second longitudinal connection 26*b*.

Figure 5:
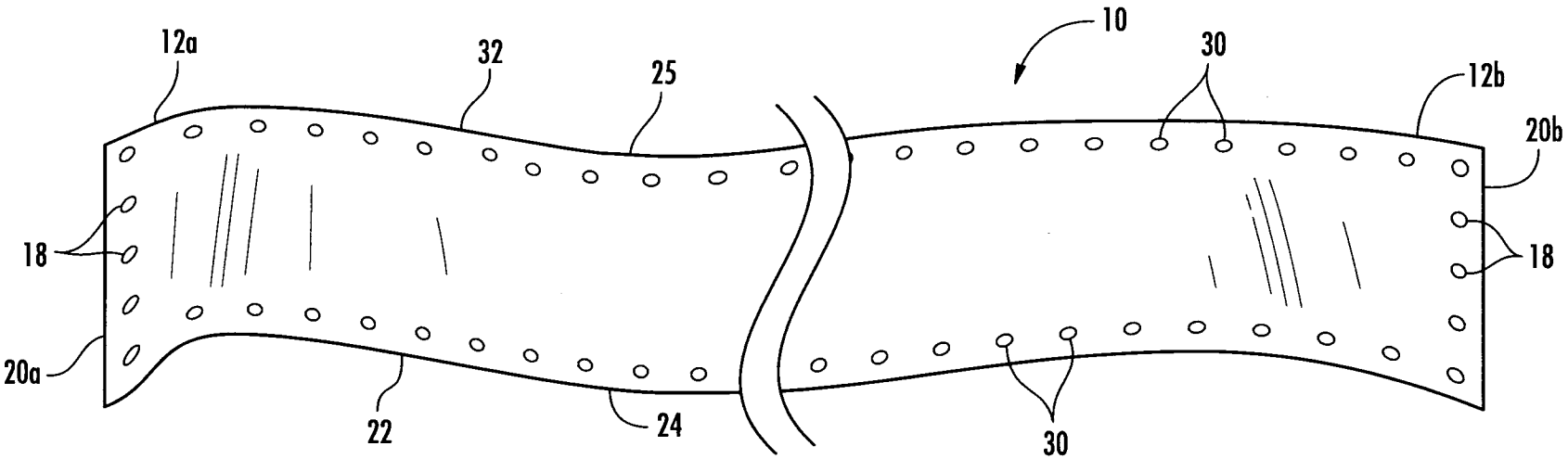
FIG. 5 is a pictorial representation of another embodiment of the dual purpose garment of the present invention.

The centrally-located section 14 typically has a length 15 in the range of from about 12 to 30 inches and is located midway along the length 23 of the elongated fabric member 22. The length 15 of the centrally-located section 14 is defined herein as the distance between longitudinal connections 26*a* and 26*b*. The length of the first and second longitudinal connections 26*a* and 26*b*, respectively, can vary widely. For an adult woman, the length is typically in a range of from about 3 to about 18 inches. In one embodiment, the first and second longitudinal connections 26*a* and 26*b*, respectively, are sewn permanently, each having a length of about 8 to 14 inches. In another embodiment, and also as shown in FIG. 5, releasably closable perimeter fasteners 30 such as buttons or snaps are affixed along the perimeter 32 of the dual purpose garment 10, and selected releasably closable perimeter fasteners 30 function to provide the first and second longitudinal connections 26*a* and 26*b*, respectively, when in a closed configuration. The remaining perimeter fasteners 30 are left in an unclosed configuration. The exact position and length of the of the first and second longitudinal connections 26*a* and 26*b*, respectively, are thus adjustable to fit the person wearing the dual purpose garment 10. In such an embodiment the releasably closable perimeter fasteners 30 are preferably decorative in appearance. The releasably closable perimeter fasteners 30 can also function as and replace fasteners 18 and 18' to secure the end sections 12*a* and 12*b* about the wrists of the wearer.

When worn as a neck scarf accessory, the centrally-located section 14, and typically at least a portion of the first and second arm-covering sections 16*a* and 16*b*, respectively, are wrapped about the neck of a person wearing the neck scarf accessory. First and second end sections 12*a* and 12*b*, respectively, extend equally from the first and second arm-covering sections 16*a* and 16*b*. Unlike the arm-covering sections 16*a* and 16*b*, however, the first and second end sections 12*a* and 12*b* are without connected longitudinal edges and thus give the appearance of a standard rectangular neck scarf when the dual purpose accessory 10 is worn about the neck leaving the first and second end sections 12*a* and 12*b* to drape down from the neck of the individual wearing the accessory. In one embodiment, the first and second end sections 12*a* and 12*b* have unconnected longitudinal edges that extend a length of at least about 3 inches. The length of the first and second end sections is defined herein as the distance between the adjacent longitudinal connection, 26*a* or 26*b*, and the respective end edge 20*a* or 20*b*.

When the dual purpose garment 10 is worn by an individual as an outer protective garment, the individual's arms and shoulders are covered in a manner that allows the hands to be free. This offers significant advantages over a standard scarf or shawl that requires continual holding and/or adjustment to remain in place.

A method of making a dual purpose garment 10 described above comprises the following steps. An elongated generally rectangular fabric member 22 as described above is provided having first and second longitudinal edges 24 and 25, respectively, with a length 23 in a range of from about 30 to 90 inches and having first and second end edges 20 *a* and 20*b*, respectively, with an end width 21 in a range of from about 6 to 24 inches or more. When using a stretchy elongated fabric member 22, dimensional estimates should be considered applicable to the fabric dimension as comfortably stretched when worn. Dimensions will vary with the size of the intended wearer as well as intended appearance. In one embodiment, the elongated fabric member 22 is provided for an average size adult woman and standard appearance garment having first and second edges with a length 23 in a range of from about 70 to 75 inches and having first and second end edges 20*a* and 20*b* with an end width 21 in a range of from about 16 to 20 inches.

First and second longitudinal connections 26*a* and 26*b*, respectively, can be sewn to provide first and second tubular arm-covering sections 16*a* and 16*b*, wherein the first and second longitudinal connections 26*a* and 26*b* extend equally from a point about 6 to 15 inches from the center of the elongated fabric member 22 toward a nearest end edge 20*a* or 20*b*. Each of the first and second longitudinal connections 24 and 25, respectively, leave at least about 3 inches for the first and second end sections 12*a* and 12*b*, respectively, and the seam does not extend into the first and second end sections 12*a* and 12*b*. The first and second end sections 12*a* and 12*b*, respectively, extend equally from the first and second longitudinal connections 26*a* and 26*b*, respectively. First fasteners 18*a* and 18*a*' are attached adjacent the first end edge 20*a* such that when fastened, the first end edge 20*a* is securable about a first wrist of a wearer. Second fasteners are attached adjacent the second end edge such that when fastened, the second end section is releasably securable about a second wrist of a wearer. Fasteners can be male and female snaps, hooks and eyes, buttons and button holes, and the like.

In another embodiment, the dual purpose garment 10 is made as described above; however, releasably closeable perimeter fasteners are sewn into the fabric along the first and second longitudinal edges to provide first and second tubular arm-covering sections. Examples of suitable perimeter fasteners include, but are not limited to, snaps, buttons and button holes, hooks and eyes, and the like. Although not necessary, typically male fastener components are provided along one of the first and second longitudinal edges, and female fastener components are provided on the other longitudinal edge. Regardless, opposing fastener components must be releasably closeable connectable.

Although the presently disclosed inventive concepts and the advantages thereof have been described in detail with reference to certain exemplary embodiments and implementations thereof, it should be understood that various changes, substitutions, alterations, modifications, and enhancements can be made to the presently disclosed inventive concepts described herein without departing from the spirit and scope thereof as defined by the appended claims. Moreover, the scope of the presently disclosed inventive concepts is not intended to be limited to the particular embodiments of the items of manufacture, processes, assemblies, compositions of matter, means, methods and steps described in the specification. As one of ordinary skill in the art will readily appreciate from the present disclosure, many equivalent items of manufacture, processes, assemblies, compositions of matter, means, methods, or steps, presently existing or later to be developed that perform substantially the same function or achieve substantially the same result as the corresponding embodiments described herein may be utilized according to the presently disclosed inventive concepts disclosed and claimed herein. Accordingly, the appended claims are intended to include within their scope all such equivalent items of manufacture, processes, assemblies, compositions of matter, means, methods, or steps.

What is claimed is:

1. A dual purpose garment positionable as a neck scarf accessory or as an outer protective garment covering at least a portion of the shoulders and arms of a person wearing the garment, the dual purpose garment comprising:

an elongated fabric member with a width and a length greater than the width, the elongated fabric member having:

a centrally-located section with a length in a range of from about 12 to 30 inches and located midway along the length of the elongated fabric member;

first and second arm-covering sections extending equally from the centrally-located section and longitudinally along the length of the elongated fabric member, the first arm-covering section having longitudinal edges connected at a first longitudinal connection to form a first tubular sleeve, the second arm-covering section also having longitudinal edges connected at a second longitudinal connection to form a second tubular sleeve; and first and second end sections extending outward equally from the first and second arm-covering sections, respectively, the first and second end sections having unconnected longitudinal edges of from about 3 to 20 inches, and end edges defined by end edges of the elongated fabric member; and wherein the centrally-located section extends in a continuous uninterrupted manner from the first longitudinal edge to the second longitudinal edge between the first longitudinal connection and the second longitudinal connection; and first and second fasteners, positioned adjacent the end edges of the first and second end sections, respectively, for releasably securing the end edges of the first and second end sections about the wrists of a person wearing the garment as an outer protective garment.

2. The dual purpose garment of claim 1, wherein the elongated fabric member is rectangular in shape.

3. The dual purpose garment of claim 1, wherein the width of the elongated fabric member is greater at the center than at the end edges.

4. The dual purpose garment of claim 1, wherein the length of the elongated fabric member is about 30 to about 90 inches.

5. The dual purpose garment of claim 1, wherein the end edges of the first and second end sections range from about 6 to 24 inches in length.

6. The dual purpose garment of claim 1, wherein the first and second longitudinal connections comprise sewn or glued seams.

7. A dual purpose garment positionable as a neck scarf accessory or as a protective garment covering at least a portion of the shoulders and arms of a person wearing the garment, the dual purpose accessory comprising:

an elongated fabric member having first and second end edges and first and second longitudinal edges, at least portions of the first and second longitudinal edges connectable to one another via releasably closeable perimeter fasteners to provide first and second tubular arm covering sections when worn as a protective garment; and first and second fasteners, positioned adjacent the end edges of the first and second end sections, respectively, for releasably securing the end edges of the first and second end sections about the wrists of the person when wearing the garment as an outer protective garment;

wherein the fabric member extends in a continuous uninterrupted fashion along an area circumscribed by the perimeter fasteners along the first and second longitudinal edges and the fasteners along the end edges.

8. The dual purpose garment of claim 7, wherein the elongated fabric member is rectangular in shape.

9. The dual purpose garment of claim 7, wherein the width of the elongated fabric member is greater at the center than at the end edges.

10. The dual purpose garment of claim 7, wherein the releasably closeable perimeter fasteners are spaced along the entire length of the first and second longitudinal edges of the elongated fabric member.

11. The dual purpose garment of claim 7, wherein the first and second tubular arm covering sections are adjustable in length and position by selective fastening and unfastening of the releasably closeable perimeter fasteners.

12. The dual purpose garment of claim 7, wherein the releasably closeable perimeter fasteners comprise buttons and button holes.

13. The dual purpose garment of claim 7, wherein the releasably closeable perimeter fasteners comprise snaps.

* * * * *